US007299618B2

(12) United States Patent
Terazaki et al.

(10) Patent No.: US 7,299,618 B2
(45) Date of Patent: Nov. 27, 2007

(54) GAS TURBINE COMBUSTION APPARATUS

(75) Inventors: Masao Terazaki, Takasago (JP); Yoshiyuki Kanezawa, Takasago (JP); Hideto Horikawa, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 314 days.

(21) Appl. No.: 10/979,738

(22) Filed: Nov. 3, 2004

(65) Prior Publication Data

US 2005/0166599 A1 Aug. 4, 2005

(30) Foreign Application Priority Data

Dec. 9, 2003 (JP) ..... 2003-409792

(51) Int. Cl.
*F02C 3/00* (2006.01)

(52) U.S. Cl. ..... 60/39.37; 60/752

(58) Field of Classification Search ..... 60/39.08, 60/752, 39.37, 805, 39.23
See application file for complete search history.

(56) References Cited

U.S. PATENT DOCUMENTS 4,255,927 A * 3/1981 Johnson et al. ..... 60/39.23
4,353,205 A * 10/1982 Cleary ..... 60/39.12
4,903,477 A * 2/1990 Butt ..... 60/39.37
5,161,367 A * 11/1992 Scalzo ..... 60/39.12
5,351,474 A * 10/1994 Slocum et al. ..... 60/39.23
6,609,379 B2 * 8/2003 Nagata et al. ..... 60/773
6,761,031 B2 * 7/2004 Bunker ..... 60/752
6,860,098 B2 * 3/2005 Suenaga et al. ..... 60/39.23
7,082,766 B1 * 8/2006 Widener et al. ..... 60/752
2002/0144507 A1 * 10/2002 Kolman et al. ..... 60/723
2002/0152751 A1 * 10/2002 Mandai et al. ..... 60/746
2004/0020212 A1 * 2/2004 Hirota et al. ..... 60/752
2005/0132708 A1 * 6/2005 Martling et al. ..... 60/752

FOREIGN PATENT DOCUMENTS

JP 6-48093 6/1994
JP 2001-107748 4/2001

* cited by examiner

*Primary Examiner*—William H. Rodriguez
(74) *Attorney, Agent, or Firm*—Westerman, Hatorri, Daniels & Adrian, LLP.

(57) ABSTRACT

A gas turbine combustion apparatus has a plurality of combustors provided in a circumferential direction within a turbine casing chamber formed by a casing, each combustor comprising a combustor inner tube and a combustor transition pipe, but lacks a turbine bypass mechanism for controlling the amount of compressed air discharged from a compressor into the turbine casing chamber. The combustion apparatus comprises an exhaust port member fitted into a manhole opening in the casing and communicating with the outside of the turbine casing chamber, bleeding pipes for uniformly bleeding compressed air discharged into the turbine casing chamber, a circular pipe for recovering compressed air bled by the bleeding pipes and discharging the compressed air to the exhaust port member, and an opening and closing valve for controlling the amount of exhaust which the circular pipe discharges to the outside of the turbine casing chamber via the exhaust port member, thereby possessing a turbine bypass mechanism.

15 Claims, 7 Drawing Sheets

GAS TURBINE COMBUSTION APPARATUS

CROSS REFERENCE TO RELATED APPLICATION

The entire disclosure of Japanese Patent Application No. 2003-409792 filed on Dec. 9, 2003, including specification, claims, drawings and summary, is incorporated herein by reference in its entirety.

BACKGROUND OF THE INVENTION

1. Field of the Invention

This invention relates to a gas turbine combustion apparatus.

2. Description of the Related Art

In recent years, various improvements have been made on a combustion apparatus in a gas turbine in order to decrease the concentrations of $NO_x$ (nitrogen oxides) in an exhaust gas, thereby achieving low $NO_x$ in the exhaust gas of the gas turbine. Methods in wide use for this purpose are those in which the total amount of compressed air is not introduced into a combustor, but instead, a bypass valve is provided, and part of compressed air is bypassed through the bypass valve.

As shown in FIG. 5, for example, a combustor 101 is composed of a combustor inner tube 102 and a combustor transition pipe 103. Within the combustor 101, fuel and compressed air are mixed. The fuel has been supplied from a fuel supply pipe 104 provided in a front end portion of the combustor inner tube 102, and has been injected by a fuel injection nozzle 105. The compressed air has been discharged from a compressor (not shown), passed through a diffuser 106, and introduced to an upstream side of the combustor inner tube 102. The mixed fuel and compressed air are burned in a combustion region on a downstream side of the combustor inner tube 102 or an upstream side of the combustor transition pipe 103, and introduced to a turbine stationary blade 107 as a combustion gas having a high temperature and a high pressure. In a turbine, this combustion gas is expanded to exert a driving force, which drives the compressor. The remaining output drives a generator or the like. Arrows in the drawing represent the flows of compressed air.

The ratio between the fuel and compressed air (i.e., fuel-air ratio) introduced into the combustor inner tube 102 needs to be controlled to an optimal value according to the operating state of the gas turbine (i.e., the amount of fuel charged). Thus, the whole of the compressed air is not introduced into the combustion region of the combustor 101, but part of the compressed air is bypassed and flowed into the combustor transition pipe 103 from a turbine casing chamber 109 formed from a casing 108. For this purpose, a bypass valve 110 is provided, thereby supplying part of compressed air from an opening of a bypass pipe 111 provided in the turbine casing chamber 109 into the combustor transition pipe 103. That is, the ratio between the fuel and the compressed air is controlled by the opening and closing amount of the bypass valve 110.

Such a gas turbine combustion apparatus is disclosed in Japanese Patent Publication No. 1994-48093. A combustion apparatus, in which compressed air discharged from a compressor is supplied not only into a turbine casing chamber, but is also passed through a regenerator aimed at heat exchange, and then the compressed air is supplied into the turbine casing chamber, is disclosed in Japanese Patent Application Laid-Open No. 2001-107748.

In recent years, environmental regulations have been gradually tightened, and $NO_x$ emission regulations are no exception. However, among gas turbines currently in operation, there are those whose existing facilities cannot comply with the $NO_x$ emission regulations. FIG. 6 shows a conventional gas turbine combustion apparatus which poses difficulty in decreasing $NO_x$ in an exhaust gas. In a gas turbine combustor of FIG. 6, a bypass valve 110 or the like, which controls the amount of compressed air within a turbine casing chamber 109, is not installed, so that even under a partial load, all of compressed air is introduced into a combustor 101. As a result, oversupply of compressed air occurs during combustion inside the combustor 101, producing large amounts of $NO_x$. If it is attempted to equip this gas turbine combustion apparatus with a bypass valve 110, a bypass pipe 111 and their associated equipment intended for decreasing $NO_x$ in the exhaust gas, a space enough for the installation of ordinary bypass equipment is not present inside the turbine casing chamber, and such equipment cannot be mounted.

If there is some space within the turbine casing chamber 109, bypass equipment as shown in FIG. 7 can be installed in the gas turbine combustion apparatus of FIG. 6. However, a bypass pipe 112 would be forcibly connected to a combustor transition pipe 103 to disfigure the bypass pipe 112. This will be seen clearly when compared with the bypass pipe 111 of FIG. 5 which has been installed beforehand. A greatly curved outer site of the bypass pipe 112, and a sharply bent inner site thereof are problematical in terms of strength, and stress imposed on these sites during operation of the gas turbine combustion apparatus may result in damage.

Furthermore, the formation of such a pipe shape leads to adverse influence on the flow of compressed air passing inside the bypass pipe 112. Even if the amount of compressed air is controlled by a bypass valve 110, it would become difficult for compressed air to flow through the bypass pipe 112 into the combustor transition pipe 103, and excess compressed air within a turbine casing chamber 109 would be introduced into the combustor 101. Thus, no decrease in $NO_x$ in the exhaust gas would be obtained.

SUMMARY OF THE INVENTION

The present invention has been accomplished to solve the above-mentioned problems. It is an object of the present invention to provide a gas turbine combustion apparatus which can be installed in existing facilities and which can stably decrease $NO_x$ in an exhaust gas according to each load.

The gas turbine combustion apparatus according to the present invention, for solving the above problems, is a gas turbine combustion apparatus having a plurality of combustors provided in a circumferential direction within a turbine casing chamber formed by a casing, each of the combustors comprising a combustor inner tube and a combustor transition pipe, and comprising:

one or more exhaust ports opening in the casing and communicating with an outside of the turbine casing chamber;

one or more bleeding means for uniformly bleeding compressed air discharged into the turbine casing chamber;

one or more recovery means for recovering compressed air bled by the bleeding means and discharging the compressed air to the exhaust ports; and exhaust control means for controlling an amount of exhaust which the recovery means discharge to the exhaust ports.

According to the above features, $NO_x$ in the exhaust gas can be stably decreased in response to each load.

In the gas turbine combustion apparatus according to the present invention, for solving the above problems, the exhaust control means may be an opening and closing valve provided in an exhaust pipe which the exhaust port has. According to this feature, the amount of exhaust of compressed air discharged into the turbine casing chamber can be reliably controlled. Since compressed air introduced into the combustor can be held at a constant level by this control, $NO_x$ in the exhaust gas can be decreased.

In the gas turbine combustion apparatus according to the present invention, for solving the above problems, the recovery means may be a circular pipe extending along the circumferential direction within the turbine casing chamber, and formed in a toroidal shape. According to this feature, compressed air bled by the respective bleeding means can be recovered reliably.

In the gas turbine combustion apparatus according to the present invention, for solving the above problems, the bleeding means may be arranged in the circumferential direction within the turbine casing chamber. According to this feature, compressed air can be uniformly bled from inside the turbine casing chamber. Thus, compressed air introduced into the combustor can be held at a constant level, and $NO_x$ in the exhaust gas can be decreased.

In the gas turbine combustion apparatus according to the present invention, for solving the above problems, the bleeding means may be bleeding pipes opening in an extending direction of the combustors. According to this feature, compressed air can be uniformly bled from inside the turbine casing chamber.

In the gas turbine combustion apparatus according to the present invention, for solving the above problems, the bleeding ports of the bleeding pipes may be arranged on the same circumference. According to this feature, compressed air can be uniformly bled from inside the turbine casing chamber.

In the gas turbine combustion apparatus according to the present invention, for solving the above problems, each of the bleeding pipes may be provided between the combust or and the combustor adjacent thereto. According to this feature, compressed air can be uniformly bled from inside the turbine casing chamber.

In the gas turbine combustion apparatus according to the present invention, for solving the above problems, the bleeding pipes may be provided between the combustors. According to this feature, compressed air can be uniformly bled from inside the turbine casing chamber.

In the gas turbine combustion apparatus according to the present invention, for solving the above problems, the exhaust port may be a manhole used during work within the turbine casing chamber. According to this feature, the exhaust port can be installed at a low cost even in the existing gas turbine combustion apparatus in which it is difficult to decrease $NO_x$ in the exhaust gas. Moreover, $NO_x$ in the exhaust gas can be stably decreased in response to each load.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
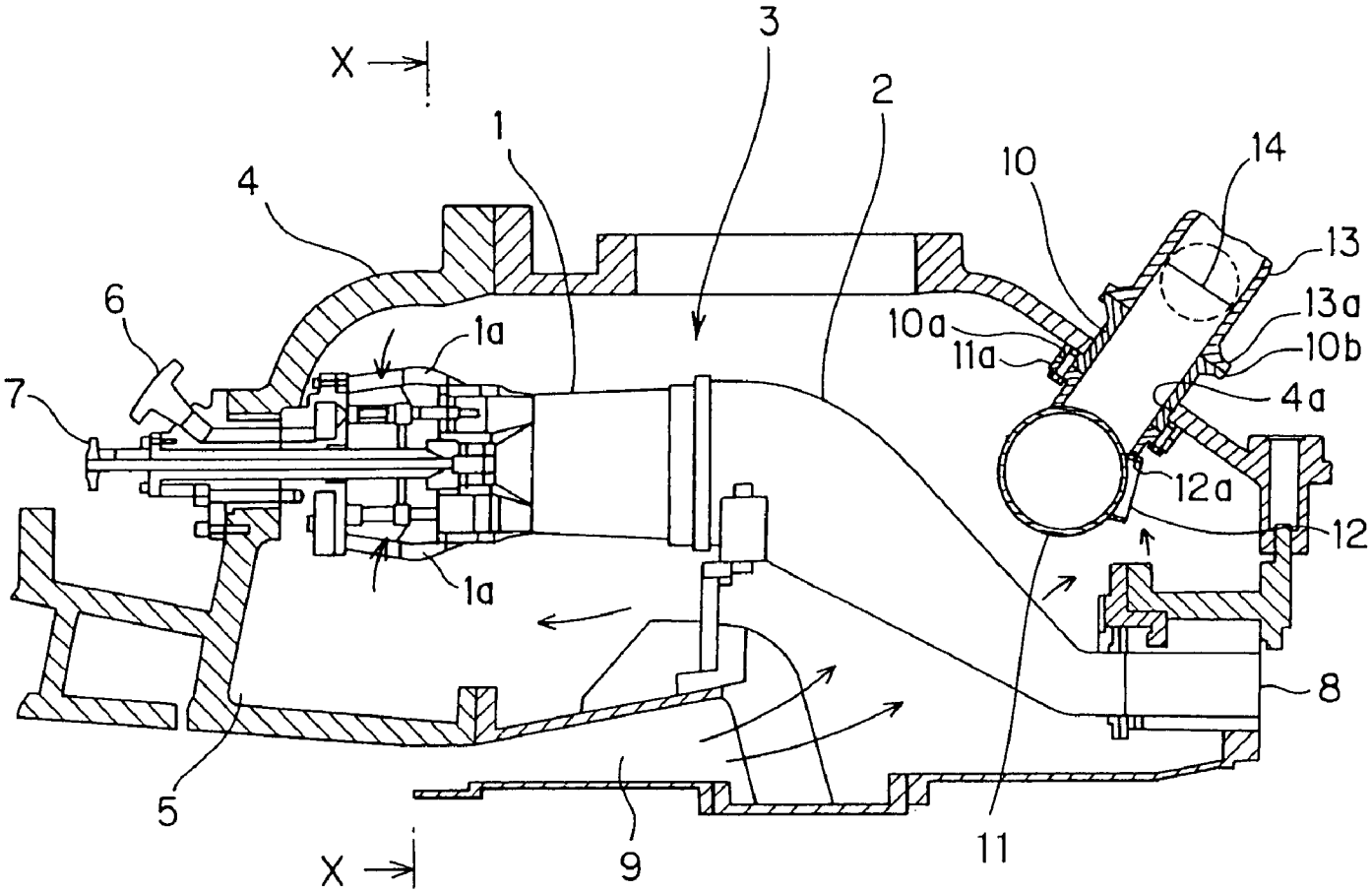
FIG. 1 is a sectional view of a gas turbine combustion apparatus according to an embodiment of the present invention.
Figure 2:
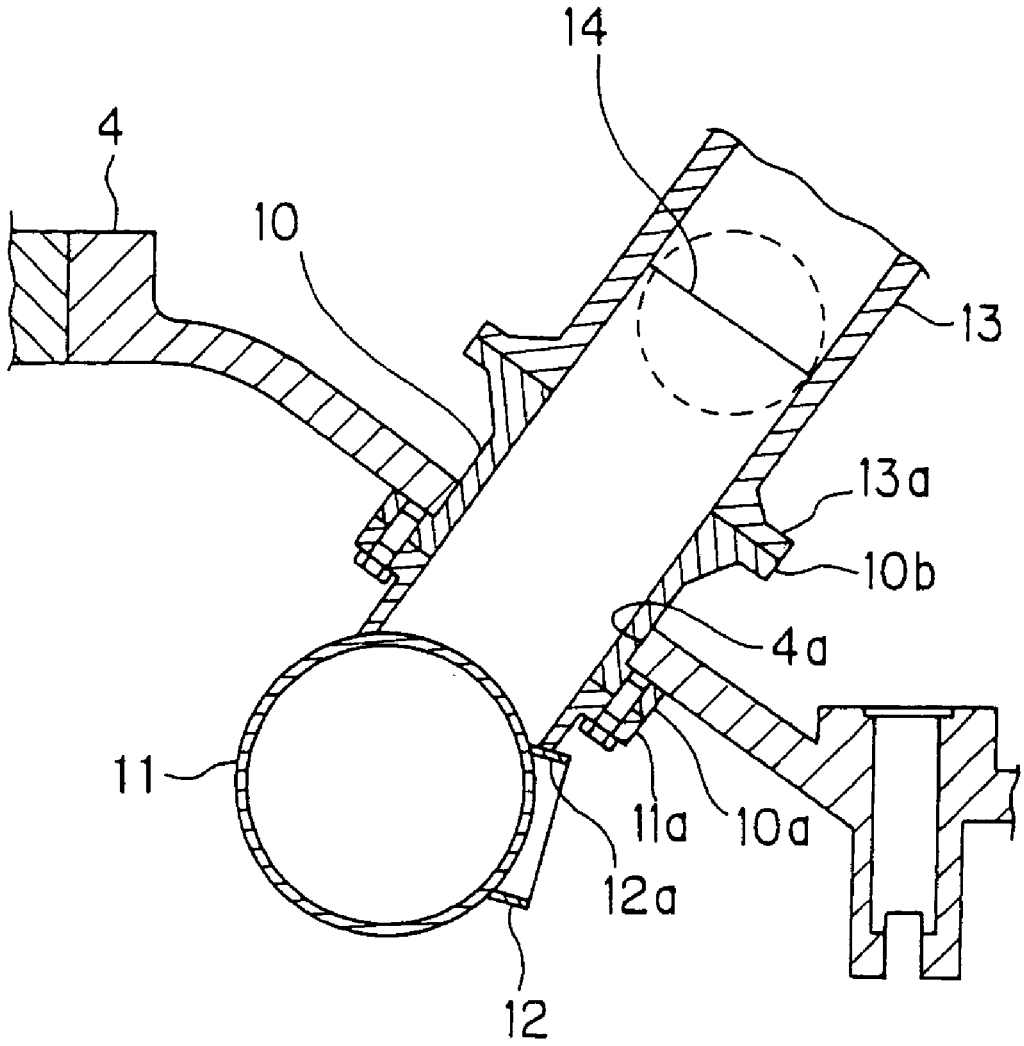
FIG. 2 is an enlarged view of essential parts of the gas turbine combustion apparatus according to the embodiment of the present invention.
Figure 3:
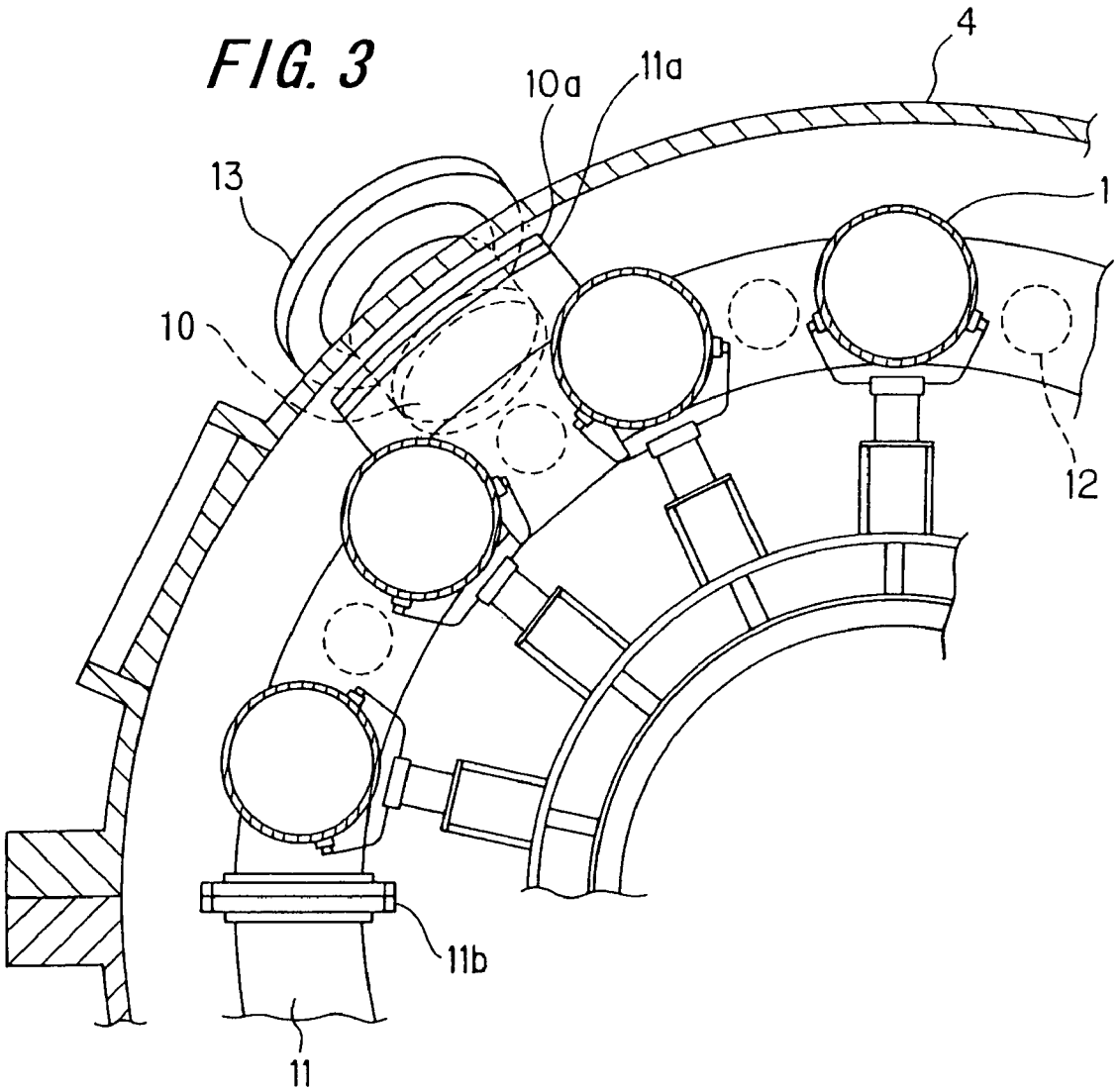
FIG. 3 is a sectional view taken on line X-X of FIG. 1.
Figure 4:
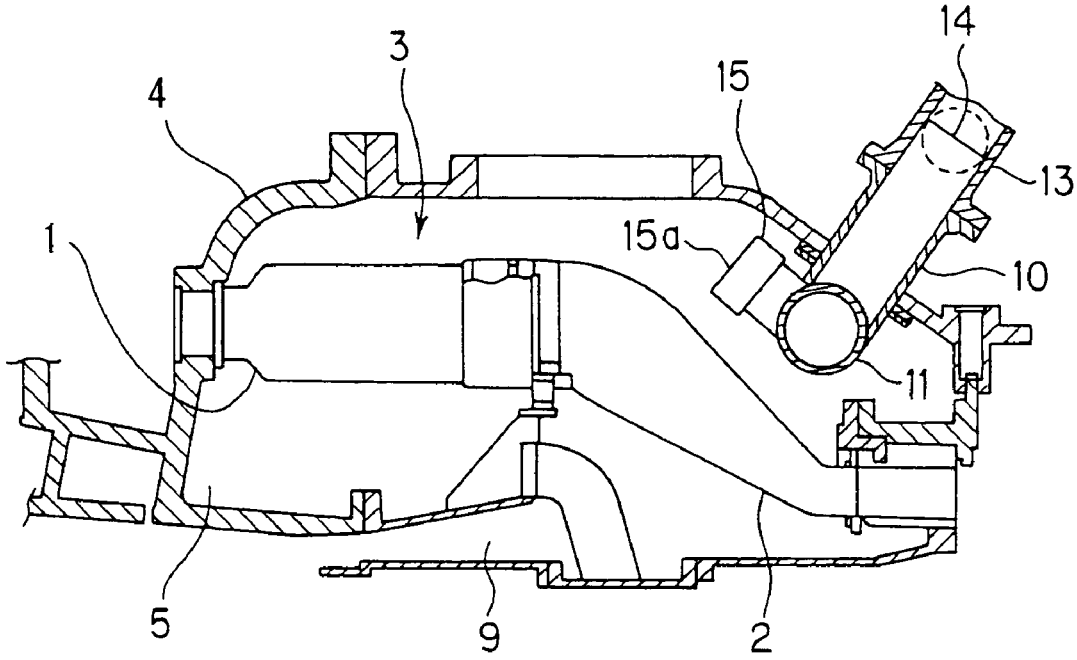
FIG. 4 is a sectional view of a gas turbine combustion apparatus showing another embodiment of the present invention.
Figure 5:
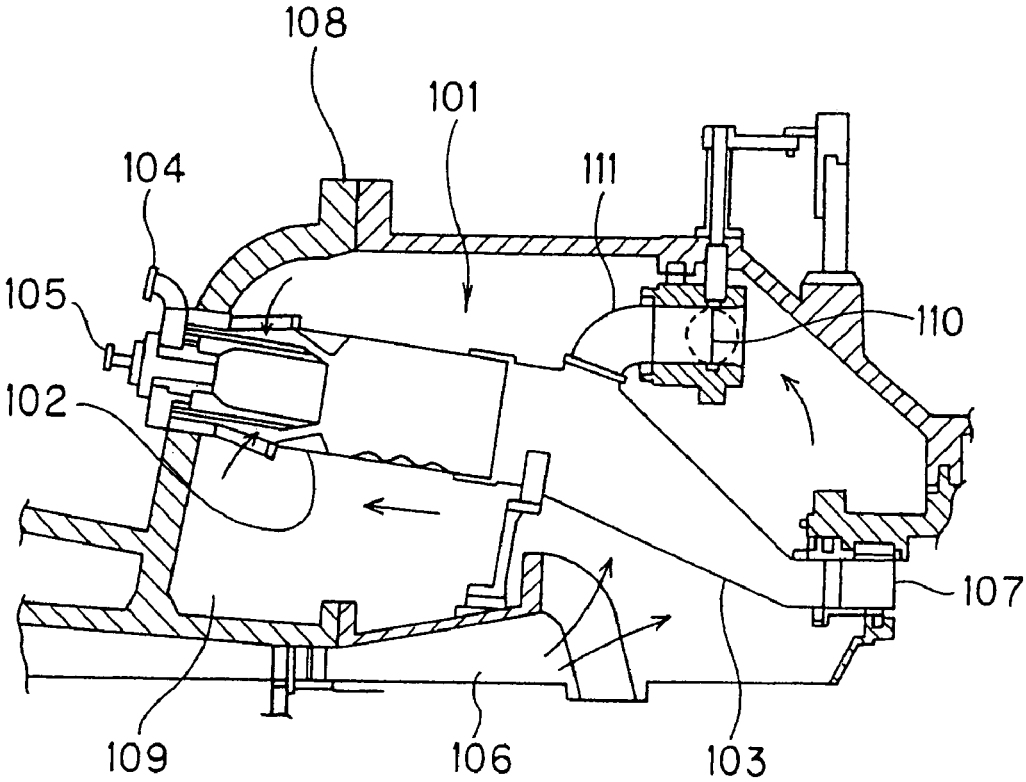
FIG. 5 (PRIOR ART)
FIG. 5 is a sectional view of a gas turbine combustion apparatus showing a conventional example.

FIG. 1 is a sectional view of a gas turbine combustion apparatus according to an embodiment of the present invention. FIG. 2 is an enlarged view of essential parts of the gas turbine combustion apparatus shown in FIG. 1. FIG. 3 is a sectional view taken on line X-X of FIG. 1. FIG. 4 is a sectional view of a gas turbine combustion apparatus showing another embodiment of the present invention. Arrows in FIG. 1 represent the flow of compressed air.

As shown in FIGS. 1, 2 and 3, a combustor 3 comprising a combustor inner tube 1 and a combustor transition pipe 2 connected together is installed in a turbine casing chamber 5 which is a space defined by a casing 4. Fourteen of the combustors 3 are installed in a circumferential direction of the turbine casing chamber 5 and with equal spacing.

A fuel supply pipe 6 for supply of fuel is provided in a front end portion of the combustor inner tube 1. Fuel, which has passed through the fuel supply pipe 6, is supplied to a fuel injection nozzle 7 provided similarly in the front end portion of the combustor inner tube 1, and is injected therethrough. Combustion air ports 1*a* for guiding compressed air, which is mixed with the fuel injected through the fuel injection nozzle 7 for use in combustion, are formed on the outer periphery of the combustor inner tube 1.

The combustor transition pipe 2 is connected to a rear end portion of the combustor inner tube 1. The combustor transition pipe 2 extends to guide a combustion gas having a high temperature and a high pressure, which is generated during combustion of the mixed fuel and compressed air, to a turbine stationary blade 8. In a turbine (not shown), this combustion gas is expanded to exert a driving force, and an excess driving force is outputted to the outside. A gas discharged from the turbine at this time is an exhaust gas.

A diffuser 9, which feeds compressed air guided from a compressor (not shown) into the turbine casing chamber 5, is provided in a lower portion of the turbine casing chamber 5. A manhole 4*a* opening in the casing 4 is formed in an upper portion of the turbine casing chamber 5. An exhaust port member 10, which serves as an exhaust port, is fitted into the manhole 4*a*.

A flange portion 10*a* is formed in the exhaust port member 10 inwardly of the casing 4 (inside the turbine casing chamber 5). The flange portion 10*a* is connected to a flange portion 11*a* of a circular pipe 11 which is toroidal piping extending in the circumferential direction of the turbine casing chamber 5 to serve as recovery means. The circular pipe 11 is connected to the flange portion 10*a*, whereby the circular pipe 11 is hermetically joined to the exhaust port member 10 to prevent leakage of compressed air. The circular pipe 11 is composed of two (upper and lower) arcuate pipings, in each of which a flange portion 11*b* is formed. These flange portions 11*b* join the arcuate pipings hermetically to constitute the toroidal piping.

A bleeding pipe 12, as bleeding means, is connected to the circular pipe 11. The bleeding pipe 12 is piping extending nearly parallel to the combustor 3. A bleeding port 12*a* of the bleeding pipe 12 is placed on the same circumference as that where each combustor 3 is located. One bleeding pipe 12 is provided between the adjacent combustors 3. In the present embodiment, 14 of the bleeding pipes 12 are installed.

On the other hand, a flange portion 10*b* is formed in the exhaust port member 10 outwardly of the casing 4 (outside the turbine casing chamber 5), and the flange portion 10*b* is connected to a flange portion 13*a* of an exhaust pipe 13. The exhaust pipe 13 is furnished with an opening and closing valve 14 which is exhaust control means for discharging compressed air from the turbine casing chamber 5 to the outside of the turbine casing chamber 5 to control the amount of exhaust. The opening and closing valve 14 is a valve controlled by a control unit or the like (not shown) so as to be opened or closed according to the operating (load) state of the gas turbine.

In accordance with the above-described features, compressed air discharged from the compressor is passed through the diffuser 9 and guided into the turbine casing chamber 5. Part of the compressed air guided to the turbine casing chamber 5 passes through the combustion air ports 1*a*, and flows into an upstream side of the combustor inner tube 1. At the same time, the partial compressed air is mixed with fuel which has been passed through the fuel supply pipe 6 and injected through the fuel injection nozzle 7. The mixed fuel and compressed air are burned in a combustion region on a downstream side of the combustor inner tube 1 or an upstream side of the combustor transition pipe 2 to generate a combustion gas having a high temperature and a high pressure. Then, the combustion gas is guided to a downstream side of the combustor transition pipe 2, and introduced to the turbine stationary blade 8. The turbine expands this combustion gas to exert a driving force, which drives the compressor. The turbine also outputs an excess driving force to the outside. At this time, the exhaust gas is discharged from the turbine.

Of the compressed air discharged from the compressor to the turbine casing chamber 5, compressed air remaining after excluding the aforementioned compressed air supplied into the combustor inner tube 1 is bled through the bleeding pipes 12. The bleeding pipes 12 are mounted along the circumferential direction of the turbine casing chamber 5, and the bleeding ports 12*a* of the bleeding pipes 12 are arranged on the same circumference as that where the combustors 3 are located. Moreover, the bleeding pipes 12 are disposed at a rate of one bleeding pipe 12 between the adjacent combustors 3. Thus, compressed air inside the turbine casing chamber 5 can be uniformly bled through the bleeding pipes 12. Compressed air bled through the bleeding pipes 12 is recovered by the circular pipe 11. The circular pipe 11 also extends in the circumferential direction of the turbine casing chamber 5 in conformity with the bleeding pipes 12, and thus can reliably recover compressed air within each bleeding pipe 12. Then, compressed air recovered by the circular pipe 11 passes through the exhaust port member 10 and the exhaust pipe 13 in this sequence, and is discharged to the outside of the turbine casing chamber 5.

At this time, the opening and closing valve 14 imparts a constant value to the mixing ratio (fuel-air ratio) between the flow rate of fuel and the flow rate of compressed air, which are supplied to the combustor inner tube 1, to adjust this mixing ratio to such a ratio as to achieve stable combustion and combustion minimal in the occurrence of $NO_x$. That is, the opening and closing valve 14 bypasses surplus compressed air within the turbine casing chamber 5 to the outside of the turbine casing chamber 5 by an opening and closing action, thereby controlling the amount of compressed air supplied into the combustor inner tube 1.

In detail, the opening and closing valve 14 exercises control in such a manner as to increase the amount of the bypassed compressed air under a low load, and decrease the amount of the bypassed compressed air under a high load. By this control, the fuel-air ratio in the combustion region in the combustor 3 can be maintained at a constant level, and the decrease in $NO_x$ in the combustion gas can be achieved. Thus, $NO_x$ in the exhaust gas discharged from the turbine can also be decreased.

Figure 6:
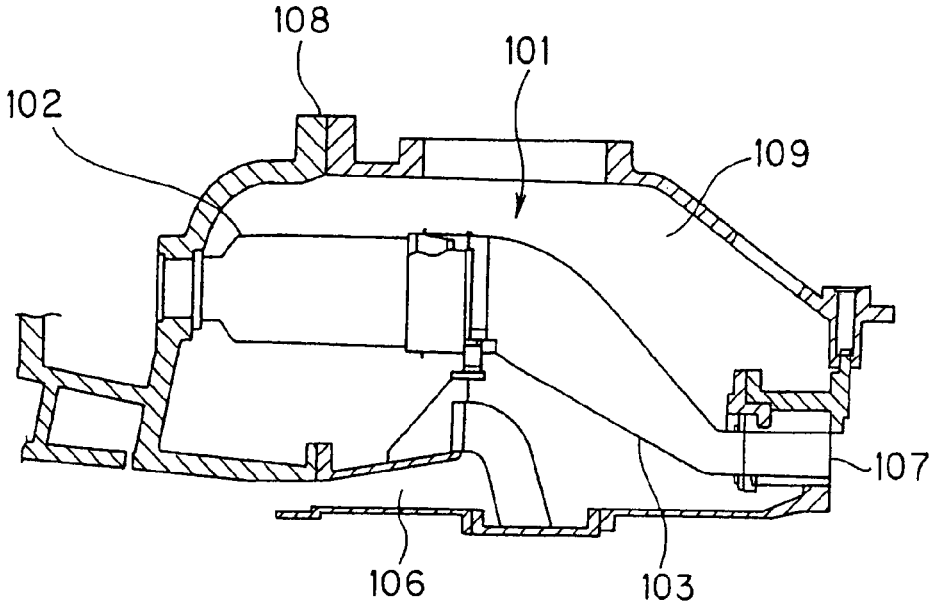
FIG. 6 (PRIOR ART)
FIG. 6 is a sectional view of a gas turbine combustion apparatus showing another conventional example.
Figure 7:
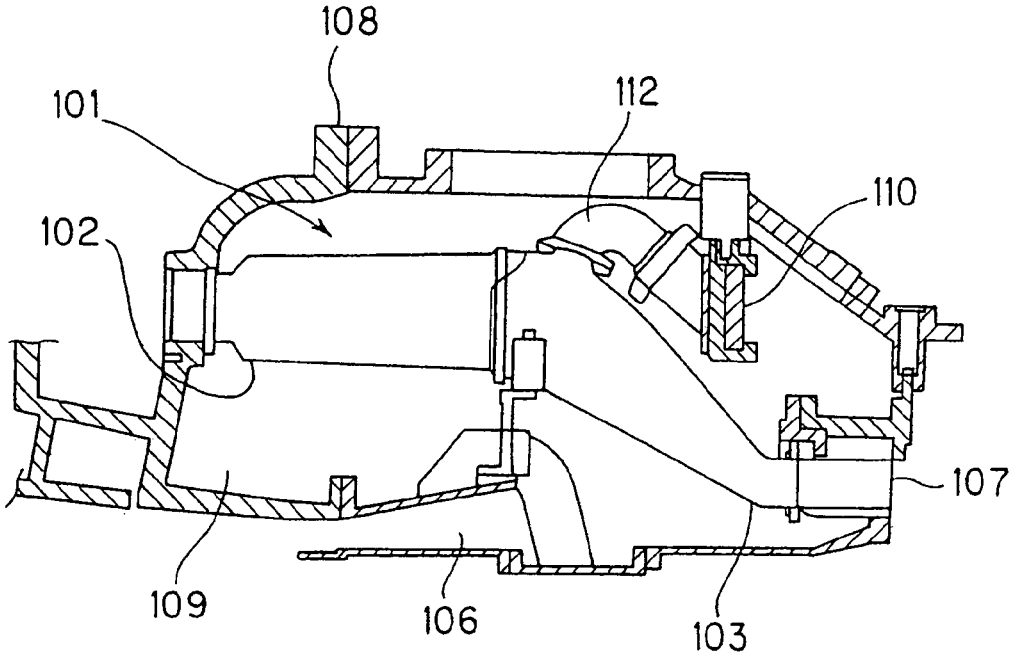
FIG. 7 (PRIOR ART)
FIG. 7 is a sectional view of the gas turbine combustion apparatus shown in FIG. 6, which is equipped with bypass equipment.

In the present embodiment, the exhaust port member 10 is fitted into the manhole 4*a* to serve as the exhaust port for compressed air. The manhole 4*a* is provided beforehand in installing the gas turbine combustion apparatus. Usually, the manhole 4*a* is used as an entrance and an exit when an operator inspects the interior of the gas turbine combustion apparatus. That is, by using the manhole 4*a* as the exhaust port, the gas turbine combustion apparatus according to the present embodiment can be constructed, even if there is no ample space in the turbine casing chamber of the conventional gas turbine combustion apparatus of FIG. 6 in which it is difficult to decrease $NO_x$ in the exhaust gas. Thus, $NO_x$ in the exhaust gas can be decreased at a low cost with the use of the existing facilities without marked modification to the gas turbine combustion apparatus. Even in a case where a gas turbine combustion apparatus is installed anew, it goes without saying that the gas turbine combustion apparatus may, from the beginning, have the configuration of the gas turbine combustion apparatus shown in the present embodiment.

According to the present invention, as described above, the gas turbine combustion apparatus having the plurality of combustors 3, each comprising the combustor inner tube 1 and the combustor transition pipe 2, the combustors being provided in the circumferential direction within the turbine casing chamber 5 formed by the casing 4, the gas turbine combustion apparatus comprising the exhaust port member 10 fitted into the manhole 4*a* opening in the casing 4 and communicating with the outside of the turbine casing chamber 5; the bleeding pipes 12 for uniformly bleeding compressed air discharged into the turbine casing chamber 5; the circular pipe 11 for recovering compressed air bled by the bleeding pipes 12 and discharging the compressed air to the exhaust port member 10; and the opening and closing valve 14 for controlling the amount of exhaust which the circular pipe 11 discharges to the outside of the turbine casing chamber 5 via the exhaust port member 10. Hence, the gas turbine combustion apparatus can achieve the decrease of $NO_x$ in the exhaust gas stably according to each load.

The opening and closing valve 14 is provided in the exhaust pipe 13. Thus, surplus compressed air inside the turbine casing chamber 5 is bypassed to the outside of the turbine casing chamber 5 by the opening and closing action of the opening and closing valve 14, whereby the mixing ratio (fuel-air ratio) between the flow rate of fuel and the flow rate of compressed air supplied to the combustor inner tube 1 can be kept constant. That is, stable combustion, and combustion decreased in the occurrence of $NO_x$ take place. Thus, $NO_x$ in the exhaust gas can be decreased.

The bleeding pipes 12 are mounted along the circumferential direction of the turbine casing chamber 5, and the bleeding ports 12*a* of the bleeding pipes 12 are arranged on the same circumference as that where the combustors 3 are located. Moreover, the bleeding pipes 12 are disposed at a rate of one bleeding pipe 12 between the adjacent combustors 3. The circular pipe 11 also extends in the circumferential direction of the turbine casing chamber 5 in conformity with the bleeding pipes 12, and thus the bleeding pipes 12 can uniformly bleed compressed air inside the turbine casing chamber 5. Compressed air bled by the bleeding pipes 12 can be reliably recovered by the circular pipe 11 with satisfactory efficiency. Thus, compressed air introduced into the combustor 3 is held constant, and $NO_x$ in the exhaust gas can be decreased.

Furthermore, the exhaust port member 10 is fitted into the manhole 4*a* which is used during work within the turbine casing chamber 5. Thus, the opening and closing valve 14 can be installed at a low cost in the existing gas turbine combustion apparatus in which it is difficult to decrease $NO_x$ in the exhaust gas. Besides, the exhaust port member 10 and the circular pipe 11 are simply joined by the flange portion 10*a* and the flange portion 11*a*, and can be detached easily. Hence, entry into and exit from the turbine casing chamber 5 during work can be easily done.

As noted above, the present invention can be applied to a gas turbine combustion apparatus having a bypass valve for controlling the amount of compressed air within a turbine casing chamber.

While the present invention has been described by the present embodiment, it is to be understood that the invention is not limited thereby, but may be varied in many other ways. For example, the number of the combustors 3 and the number of the bleeding pipes 12 are each set at 14, but the numbers are not limited to this figure. Moreover, the circular pipe 11 is composed of the two arcuate pipings, but is not limited to this figure, as long as any number of such arcuate pipings are finally formed into a toroidal form. The pipe diameter of the exhaust port member 10, the pipe diameter of the circular pipe 11, and the bore of the bleeding port 12*a* may be changed, as appropriate, according to the amount of exhaust and the amount of bleed of compressed air. The bore of each bleeding port 12*a* need not be the same. Furthermore, the direction of the bleeding port 12*a* can be the same as the direction of a bleeding port 15*a* of a bleeding pipe 15 as shown in FIG. 4. Such variations are not to be regarded as a departure from the spirit and scope of the invention, and all such modifications as would be obvious to one skilled in the art are intended to be included within the scope of the appended claims.

What is claimed is:

1. A gas turbine combustion apparatus having a plurality of combustors provided in a circumferential direction within a turbine casing chamber formed by a casing, each of said combustors comprising a combustor inner tube and a combustor transition pipe, and comprising:

one or more exhaust ports opening in said casing and communicating with an outside of said turbine casing chamber and having an exhaust pipe;

one or more bleeding means for uniformly bleeding compressed air discharged into said turbine casing chamber;

one or more recovery means for recovering compressed air bled by said bleeding means and discharging said compressed air to said exhaust ports; and exhaust control means for controlling an amount of exhaust which said recovery means discharge to said exhaust ports, wherein said recovery means is a circular pipe extending along said circumferential direction within said turbine casing chamber, and formed in a toroidal shape.

2. A gas turbine combustion apparatus having a plurality of combustors provided in a circumferential direction within a turbine casing chamber formed by a casing, each of said combustors comprising a combustor inner tube and a combustor transition pipe, and comprising:

one or more exhaust ports opening in said casing and communicating with an outside of said turbine casing chamber;

one or more bleeding means for uniformly bleeding compressed air discharged into said turbine casing chamber;

one or more recovery means for recovering compressed air bled by said bleeding means and discharging said compressed air to said exhaust ports; and exhaust control means for controlling an amount of exhaust which said recovery means discharge to said exhaust ports, wherein said exhaust control means is an opening and closing valve provided in said exhaust pipe; and wherein said recovery means is a circular pipe extending along said circumferential direction within said turbine casing chamber, and formed in a toroidal shape.

3. The gas turbine combustion apparatus according to claim 1 or claim 2, wherein said one or more bleeding means is arranged in said circumferential direction within said turbine casing chamber.

4. The gas turbine combustion apparatus according to claim 3, wherein said one or more bleeding means comprises one or more bleeding pipe opening in an extending direction of said combustors.

5. The gas turbine combustion apparatus according to claim 4, wherein said one or more bleeding pipe comprises one or more bleeding port and each pipe and each port is arranged on a same circumference.

6. The gas turbine combustion apparatus according to claim 5, wherein each of said one or more bleeding pipe is provided between a combustor of said plurality of combustors and another combustor of said plurality of combustors adjacent to said combustor.

7. The gas turbine combustion apparatus according to claim 6, wherein said one or more bleeding pipe is provided between a combustor of said plurality of combustors and another combustor of said plurality of combustors.

8. The gas turbine combustion apparatus according: to claim 7, wherein said exhaust port is a manhole used during work within said turbine casing chamber.

9. A gas turbine combustion apparatus having a plurality of combustors provided in a circumferential direction within a turbine casing chamber formed by a casing, each of said combustors comprising a combustor inner tube and a combustor transition pipe, and comprising:

one or more exhaust ports opening in said casing and communicating with an outside of said turbine casing chamber;

one or more bleeding means for uniformly bleeding compressed air discharged into said turbine casing chamber;

one or more recovery means for recovering compressed air bled by said bleeding means and discharging said compressed air to said exhaust ports; and exhaust control means for controlling an amount of exhaust which said recovery means discharge to said exhaust ports, wherein said bleeding means are arranged in said circumferential direction within said turbine casing chamber.

10. A gas turbine combustion apparatus having a plurality of combustors provided in a circumferential direction within a turbine casing chamber formed by a casing, each of said combustors comprising a combustor inner tube and a combustor transition pipe, and comprising:

one or more exhaust ports opening in said casing and communicating with an outside of said turbine casing chamber and having an exhaust pipe;

one or more bleeding means for uniformly bleeding compressed air discharged into said turbine casing chamber;

one or more recovery means for recovering compressed air bled by said bleeding means and discharging said compressed air to said exhaust ports; and exhaust control means for controlling an amount of exhaust which said recovery means discharge to said exhaust ports, wherein said exhaust control means is an opening and closing valve provided in said exhaust pipe, wherein said bleeding means are arranged in said circumferential direction within said turbine casing chamber.

11. The gas turbine combustion apparatus according to claim 9 or claim 10, wherein said bleeding means are bleeding pipes opening in an extending direction of said combustors.

12. The gas turbine combustion apparatus according to claim 11, wherein said bleeding pipes comprise bleeding ports which are arranged on a same circumference.

13. The gas turbine combustion apparatus according to claim 12, wherein each of said bleeding pipes is provided between said combustor and said combustor adjacent thereto.

14. The gas turbine combustion apparatus according to claim 13, wherein said bleeding pipes are provided between said combustors.

15. The gas turbine combustion apparatus according: to claim 14, wherein said exhaust port is a manhole used during work within said turbine casing chamber.

* * * * *